US005669424A

United States Patent [19]

Schiller et al.

[11] Patent Number: 5,669,424

[45] Date of Patent: Sep. 23, 1997

[54] COMBINED AND RELATIVELY ADJUSTABLE WEFT THREAD CLAMP AND CUTTER

[75] Inventors: Peter Schiller, Lindau, Germany; Josef Hehle, Hoerbranz, Austria

[73] Assignee: Lindauer Dornier Gesellschaft mbh, Lindau, Germany

[21] Appl. No.: 671,059

[22] Filed: Jun. 27, 1996

[30] Foreign Application Priority Data

Jun. 28, 1995 [DE] Germany ..... 19523458.8
Jun. 28, 1995 [DE] Germany ..... 29510465 U

[51] Int. Cl.[6] ..... D03D 47/34

[52] U.S. Cl. ..... 139/450; 139/263; 139/434; 83/466; 66/145 R

[58] Field of Search ..... 83/466; 66/145 R, 66/140 R, 134; 139/263, 450, 434

[56] References Cited

U.S. PATENT DOCUMENTS

| | | | |
|---|---|---|---|
| 2,319,181 | 5/1943 | Nichols | 139/263 |
| 2,684,085 | 7/1954 | Harris et al. | 139/263 X |
| 3,598,158 | 8/1971 | Hall | 139/145 R |
| 3,995,456 | 12/1976 | Wright | 66/140 R |
| 4,078,586 | 3/1978 | Porter et al. | 139/450 |
| 5,199,468 | 4/1993 | Aarts et al. | 139/450 |
| 5,201,346 | 4/1993 | Cox | 139/450 |

*Primary Examiner*—Andy Falik
*Attorney, Agent, or Firm*—W. G. Fasse; W. F. Fasse

[57] ABSTRACT

A combined weft thread clamp and cutter apparatus for an air jet loom includes a cutter (3) for cutting a weft thread (1) and a clamp (4) for clamping the weft thread (1). The cutter includes a fixed cutter element (10) and a movable cutter element (9) that is movable relative to the fixed cutter element. The clamp includes a first clamp element (14) and a second clamp element (13). The clamp (13, 14) and the cutter (9, 10) are arranged next to each other, and a spacing distance (8) between the clamp (13, 14) and the cutter (9, 10) is adjustable. The clamping surface of at least one of the clamp elements (13, 14) can be an elastically yielding surface.

26 Claims, 2 Drawing Sheets

COMBINED AND RELATIVELY ADJUSTABLE WEFT THREAD CLAMP AND CUTTER

FIELD OF THE INVENTION

The invention relates to a combined weft thread clamp and cutter for an air jet weaving loom, having two cutter elements of which one element is movable relative to the other, and having two clamp elements of which at least one element is movable relative to the other.

BACKGROUND INFORMATION

Weft thread clamps and cutters are required in air jet looms. A weft thread that has been inserted into a loom shed is caught and clamped by the clamp and is cut by the cutter. The clamp is not only required to ensure a neat, clean cut by the cutter, but is also necessary in conjunction with tensioning means to maintain a certain tension on the weft thread.

It is already known in the prior art to combine a clamp, which is constructed essentially of two elements, and a cutter, which is also constructed of two elements, into a single apparatus in which the respective fixed elements of the clamp and the cutter are coupled with each other, while the respective other or movable elements remain separate. A disadvantage of such known embodiments is that it is not possible to adjust the distance between the thread clamp and the cutter. The thread end that extends laterally beyond the clamp to the cutter thus always has to have a certain length.

With various types of cloth, however, the cloth width shrinks immediately after the binding or interlacing point. This shrinkage is known as a filling take-up shrinkage and is defined as the ratio between the weaving width i.e. the width of the reed and the actual width of the cloth directly following the binding point. This ratio by definition is greater than or equal to 1. There are various causes for the filling take-up shrinkage, as known to persons of ordinary skill in the art.

Due to such shrinkage, each respective weft thread must extend relatively far laterally beyond the clamp directly after the respective thread is cut to ensure that, as the width of the cloth shrinks due to the filling take-up, the weft thread remains clamped in the clamp. It is necessary to hold the thread in the clamp to prevent the formation of distortions or other faults, or a ragged edge, in the cloth. The extent of the filling take-up shrinkage varies from cloth to cloth and thus, the distance the weft thread must extend beyond the width of the cloth or beyond the clamp also varies. The excess projecting length of the thread should not be too small, because otherwise the thread will pull out of the clamp due to the ensuing filling take-up shrinkage. On the other hand, the excess projecting length should not be too large, because that results in unnecessary consumption of weft thread material.

In known weft thread clamps, it has been found to negatively influence the clamping function and the stress on the weft thread if the clamping surfaces of the device do not possess the necessary static friction for the thread. If the static friction is insufficient, it cannot be reliably ensured that the clamped weft thread end will actually remain tightly clamped or held in the clamp, rather than being pulled out of the clamp.

OBJECTS OF THE INVENTION

In view of the above it is the aim of the invention to achieve the following objects singly or in combination:

- to provide a weft thread clamping and cutting apparatus that can be adjusted or adapted depending upon the characteristics or behavior of the respective cloth directly after the interlacing or binding-in, e.g. depending upon the filling take-up shrinkage characteristic of the cloth;
- to provide a weft thread clamping and cutting apparatus that can be adapted to various thread parameters, such as the thread diameter or surface texture;
- to prevent a weft thread from pulling out of the clamp due to filling take-up shrinkage and to avoid unnecessary waste of weft material by making the spacing distance between the clamp and the cutter adjustable; and
- to ensure proper clamping of the weft thread and maintain a correct tension on the weft thread so as to prevent the cloth from distorting and/or developing a ragged edge, to prevent the threads from being damaged by the clamp surfaces, to reliably clamp different types or thicknesses of weft threads, and to allow for greater tolerances in the manufacture of the clamps, by providing a clamp with at least one clamp surface that is constructed as a replaceable or exchangeable elastic element.

SUMMARY OF THE INVENTION

The above objects have been achieved according to the invention in a combination weft thread clamp and cutter apparatus for an air jet loom. The apparatus includes a cutter having a fixed cutter element and a movable cutter element that is movable relative to the fixed cutter element, and a weft clamp having a first clamp element and a second clamp element wherein at least one of the clamp elements is movable relative to the other. The apparatus further includes an adjustment mechanism for adjusting a spacing distance between the clamp and cutter. The weft clamp according to another aspect of the invention especially includes a clamp element or a clamp jaw insert that is made of an elastic material.

Special features of the invention are that the distance between the clamp and the cutter is adjustable, and that the clamp surfaces of the clamp are less damaging to the thread than are clamps according to the prior art.

The first embodiment of the invention has several advantages. The apparatus according to the invention can be optimally adapted to the specific behavior of the cloth regarding the filling take-up shrinkage and various thread parameters. The distance between the cutter and the clamp can be adjusted depending upon the magnitude of the cloth take-up shrinkage, thus making it possible to successfully prevent the thread from pulling out of the clamp and to avoid the need of an excessive protruding thread length. Adjusting the distance between the clamp and the cutter can reduce the amount of waste of weft material. A weft thread can be supplied at the proper length corresponding to the distance between the clamp and the cutter, thereby avoiding waste of weft material. Furthermore, it is possible to remove the clamp entirely in various special cases, thereby allowing the cutter to be pushed directly to the edge of the cloth, which again reduces weft material waste. An additional advantage is that it is not necessary to form a so-called catch selvage.

A preferred embodiment involves mounting the clamp and cutter apparatus on a common bracket or support member that can be adjusted to the width of the loom. The exact spacing distance can be adjusted either by pushing the cutter relative to the clamp or vice versa. A substantial advantage with this embodiment is that not only the distance between the clamp and the cutter, but also the distance between the clamp and the edge of the cloth can be adjusted. It is thus possible to bring the clamp very close to the edge of the cloth to achieve an initial adjustment of the distance. The respective particular distance required between the cutter and the clamp can then be adjusted subsequently. It is also possible to set or fix the distance between the clamp and the cutter first, and then to adjust the two devices as one unit to the cloth width. Clamping screws, spacers or shims, spindle screws, or other suitable means can be used to adjust the spacing. Preferably both a rough and fine adjustment are provided.

In a further preferred embodiment of the invention, the fixed part of the thread clamp is constructed as an elastic element. The elastic element may, for example, be a molded rubber part or be made of an elastic synthetic material. Various advantages are achieved with this embodiment. First, the invention hereby avoids damage to the weft threads that is typically caused by the relatively hard clamp surfaces of the prior art. As in the prior art, the movable clamp element presses the weft threads against the opposite clamp element under the effect of a spring-loading force. However, according to the invention this second or opposite clamp element is elastic and can yield so that the weft threads are subjected overall to a lower stress when clamped. This elastic construction results in reliable clamping, even with weft threads having different thicknesses. Namely, the elastic clamp element of the weft thread clamp is preferably so constructed that the thick threads are pressed to a greater extent into the elastic material than are the thinner threads, thereby equalizing or evening-out the distance between the clamp elements of the weft clamp.

It is also possible to allow wider production tolerances with regard to the smoothness of the clamping surfaces. The elasticity of the lower clamp element compensates for possible unevenness or roughness that results in the manufacture of the clamping surfaces of the two clamp elements. Thus, the weft threads are held reliably even when the clamp surfaces are comparably more uneven than was allowed with the prior art clamps. Furthermore, the surface shape of the elastic clamp element is not subject to the restraints that previously applied when hard clamping surfaces were used. It is possible to clamp the thread, for example, between two substantially uneven surfaces. It is also possible to construct the elastic clamp element to have an approximately V-shaped groove therein, whereby the weft thread runs perpendicular to the lengthwise direction of the groove. Thus it is possible to achieve multiple deflections of the thread and a reliable clamping thereof.

Furthermore, the clamping surface of the elastic clamp element may be constructed as a slanted surface or with a zigzag profile. In the latter embodiment, the weft thread preferably runs perpendicular to the zigzag ridges, and is clamped or held essentially only against the tips of the individual zigzag ridges by the movable clamp element of the weft thread clamp. Since these ridges are constructed elastically, they will give or yield and will not negatively influence the structure of the weft thread.

It is also possible to provide the clamping surfaces of the clamp elements with a fine ribbing. This ribbing can run parallel or perpendicular to the weft thread, or in other directions. When the clamping profiles are slanted relative to the weft thread, a further advantageous effect is achieved in that an additional tension is applied to the weft thread toward the outside, when the thread is pushed across the elastic clamp element. The weft thread is thus pulled taut, which has an overall advantageous effect on the formation of the cloth.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
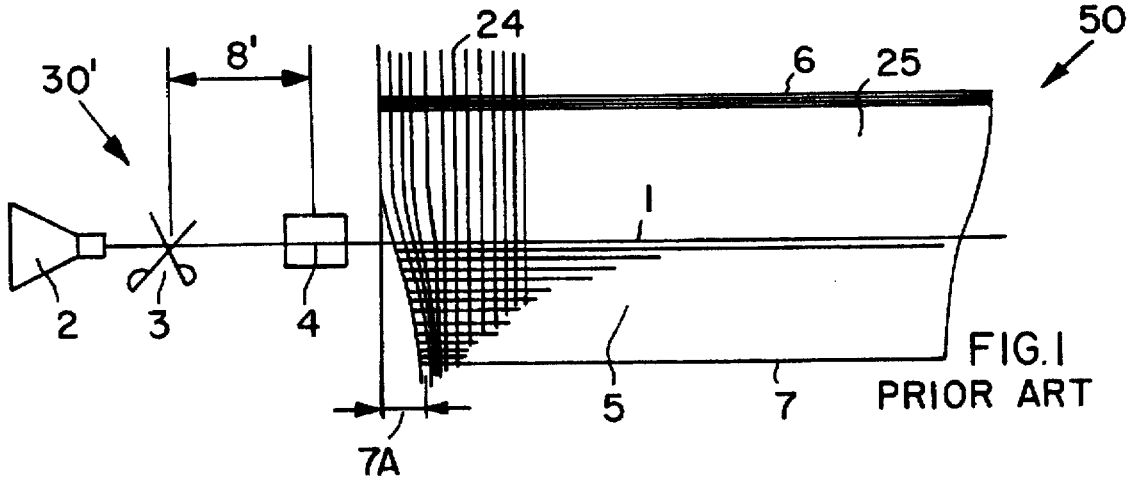
FIG.1 PRIOR ART
FIG. 1 is a schematic view of the arrangement of a weft thread clamp and cutter apparatus according to the prior art in the area of weft thread insertion on an air jet loom.

FIG. 1 schematically shows the known arrangement of a weft thread clamp and cutter apparatus 30' in an air jet loom 50. A main jet 2 inserts a weft thread 1 into a loom shed 25 formed by warp threads 24, whereby the weft thread 1 passes through a cutter 3 and a clamp 4 of the clamp and cutter apparatus 30'. In the embodiment shown, the width of a reed 6 is slightly larger than he width of a woven cloth 7 that is being produced, resulting in a filling take-up shrinkage 7A greater than one, i.e. represented mathematically as (reed width)÷(cloth width)>1. In the known arrangement 30', a spacing distance 8' between the cutter 3 and the clamp 4 is fixed or non-adjustable.

Figure 2:
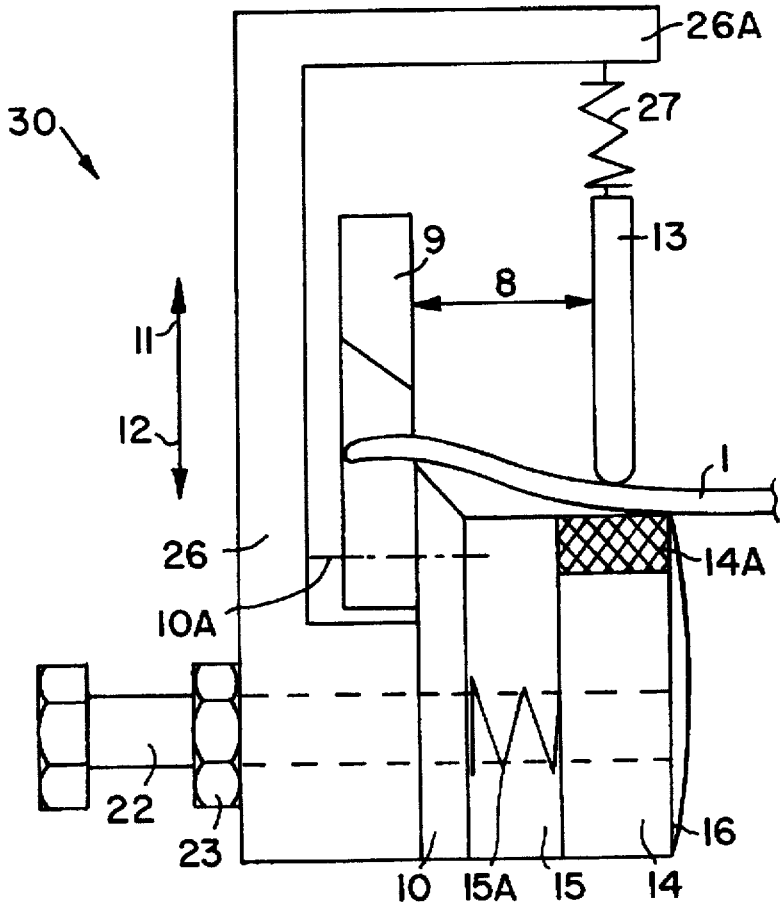
FIG. 2 is a schematic front view of a thread clamp and cutter apparatus according to the invention, mounted on a bracket of an air jet loom.

FIG. 2 shows the detailed construction of a combined arrangement 30 according to the invention, including a cutter 3 and a clamp 4. The cutter includes two scissor elements or cutter elements 9 and 10. The upper cutter element 9 is movable in the directions of arrows 11 and 12 and cooperates with the fixed lower cutter element 10 to cut the weft thread 1 that has been inserted into the loom shed from the weft thread supply (not shown) that is held ready in the main jet 2 for the next insertion. Two clamp elements 13 and 14 are provided for clamping the weft thread 1 that has been inserted into the loom shed 25.

According to the invention, a spacing distance 8 between the cutter elements 9 and 10 and the clamp elements 13 and 14 is adjustable. In order to achieve this, a spacer 15 is provided on the lower cutter element 10, and specifically between the lower cutter element 10 and the lower clamp element 14. A retainer 16 is provided on a side that is close to the free end of the clamp element 14. The retainer 16 cooperates with at least one adjusting screw 22, for example, to connect the parts 10, 14, and 15 to a bracket 26 that is adjustably mounted on a loom frame component (not shown). The upper cutter element 9 is coupled with the corresponding lower element 10 at a pivot axis 10A, which is shown schematically. The spacer 15 may be dimensionally stable or fixed, or dimensionally variable. To adjust the distance 8, an adjusting nut 23 provided on the adjusting screw 22 is loosened, and then the spacer 15 is removed and replaced by another spacer having a different width or thickness (in the case of a dimensionally stable spacer), or the spacer 15 is a spring 15A (in the case of a dimensionally variable spacer).

The upper clamp element 13, for example, is biased by a compression spring 27, which is connected to and supported by a support arm 26A of the bracket 26. For adjusting the spacing distance 8, i.e. when for example the spacer 15 is replaced by a wider or narrower spacer, the upper clamp element 13 is manually moved or adjusted in correspondence or alignment with the lower clamp element 14. For example, the upper clamp element 13 may be slidingly adjusted along the support arm 26A and then fixed in the desired position with a set screw or the like. Alternatively, the upper clamp element 13 can be adjusted by placement of spacers, like the lower element 14, or can be connected to the lower element 14 to be laterally movable therewith. It is alternatively possible to provide another suitable component, for example a spring element 15A, instead of the spacer 15.

Figure 3:
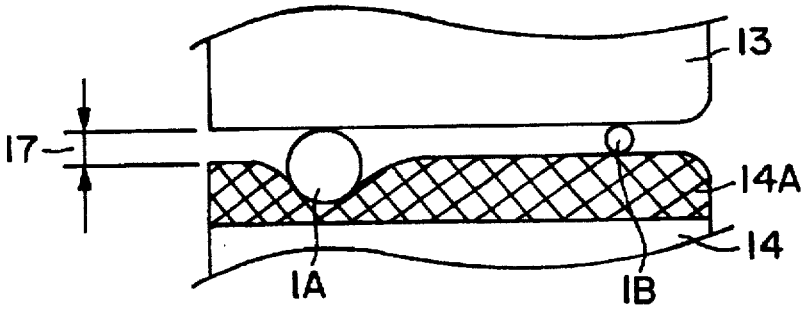
FIG. 3 is a schematic side view of the clamp, holding two threads of different thicknesses, in the direction of arrow III in FIG. 2.
Figure 4:
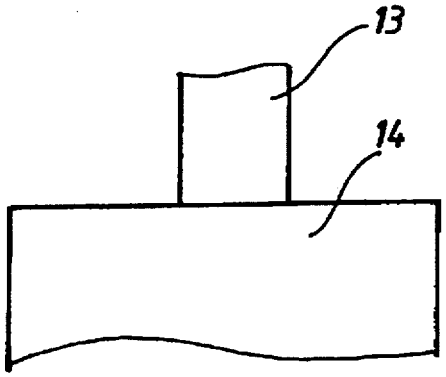
FIGS. 4–7 show various embodiments of the clamping surfaces of the clamp elements as seen in the direction of arrow IV in FIG. 3.
Figure 5:
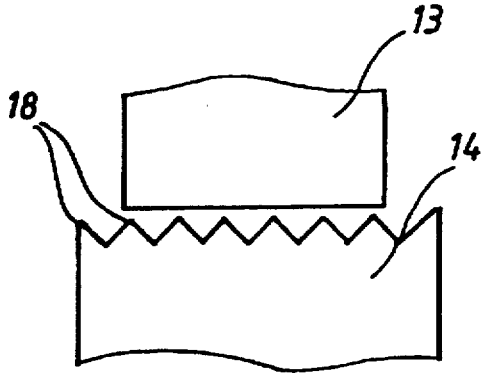
Figure 6:
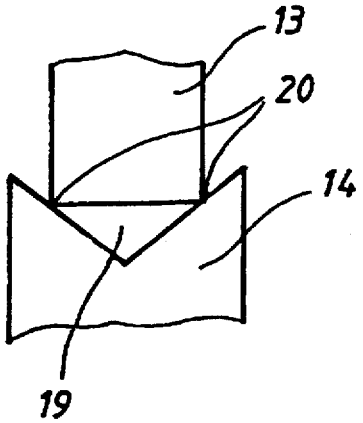

In a further embodiment of the invention, the lower clamp element 14 is constructed elastically or at least comprises at least one elastic clamp jaw insert 14A as shown in FIG. 2. Several detailed embodiments of elastic clamp inserts 14A are shown in FIGS. 3 to 8. FIG. 3 shows clearly that a distance 17 between the clamp elements 13 and 14 remains essentially constant, even when clamping weft threads 1A and 1B of different thicknesses, because the thicker weft thread 1A can be pressed into the elastic jaw insert 14A of the element 14. Moreover, inaccuracies in the manufacture of the surfaces of the clamp elements can be compensated by the clamp insert 14A of the clamp element 14 because of the elastic nature of the clamping surface.

Figure 7:
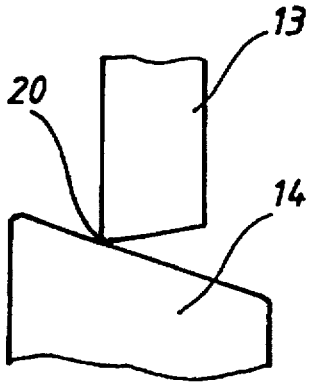
Figure 8:
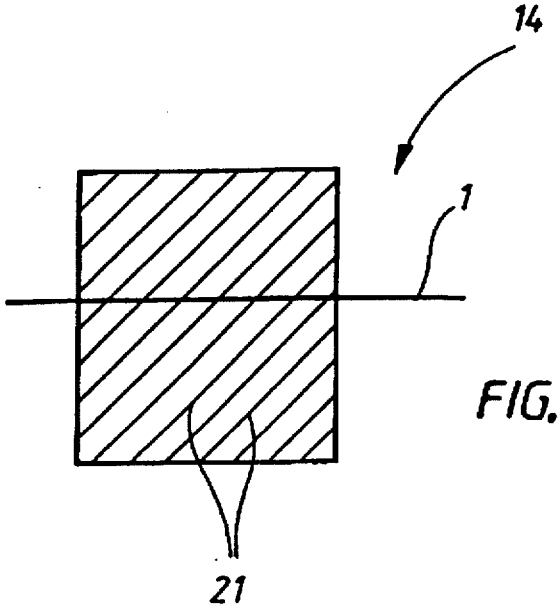
FIG. 8 is a top view of a lower clamp element.

The clamp element 14 or clamp insert 14A can have various different embodiments as shown in FIGS. 4 to 7. The surface can, for example, be smooth (FIG. 4), have a zigzag profile 18 (FIG. 5), have an approximately V-shaped groove 19 (FIG. 6), or can be in the form of a slanted surface (FIG. 7). At least one weft thread is held at the respective points of contact between the clamp element 13 and the clamp element 14. It is possible to provide the clamp element 13 with a rounded edge or radius 20 at these points of contact, as shown in FIG. 7 for example. As shown in FIG. 8, ribs or ridges 21 can extend at a diagonal relative to the weft thread 1 to achieve the advantages described above. It should also be understood that different inserts 14A or elements 14 can be exchanged as needed for different weaving requirements.

The described and illustrated embodiments provide very good adaptability to various weaving conditions and thread parameters. The length of the weft thread 1 extending beyond the edge of the woven cloth 5 can be determined or set by adjusting the distance 8 between the cutter 3 and the clamp 4. The achieved clamping effect as well as the special embodiments of the clamp 4 can be adapted to various weaving conditions and thread parameters as needed in a simple manner, due to the easy replaceability or exchangeability of the spacer 15 and of the clamp element 14.

Although the invention has been described with reference to specific example embodiments, it will be appreciated that it is intended to cover all modifications and equivalents within the scope of the appended claims.

What we claim is:

1. A combination weft thread clamp and cutter apparatus for an air jet loom, comprising a cutter including a fixed cutter element and a movable cutter element that is adapted to be movable relative to said fixed cutter element, a weft clamp including a first clamp element and a second clamp element arranged to selectively cooperate with one another wherein at least one of said clamp elements is adapted to be movable relative to another of said clamp elements, and an adjustment mechanism adjustably connecting said cutter with said weft clamp such that a spacing distance between said weft clamp and said cutter is adjustable, wherein said adjustment mechanism is arranged so that said adjustable spacing distance extends in a horizontal plane.

2. A combination weft thread clamp and cutter apparatus for an air jet loom, comprising a cutter including a fixed cutter element and a movable cutter element that is adapted to be movable relative to said fixed cutter element, a weft clamp including a first clamp element and a second clamp element arranged to selectively cooperate with one another wherein at least one of said clamp elements is adapted to be movable relative to another of said clamp elements, an adjustment mechanism adjustably connecting said cutter with said weft clamp such that a spacing distance between said weft clamp and said cutter is adjustable, and a mounting bracket, wherein said cutter is mounted on said bracket, and wherein said adjustment mechanism comprises a spacer member that is selectably arranged to adjust and set said spacing distance.

3. The apparatus of claim 2, wherein said spacer member has a fixed stable dimension in a direction of said spacing distance, wherein said adjustment mechanism further comprises an adjusting screw, wherein said spacer member is arranged between said fixed cutter element and said first clamp element, and wherein said adjusting screw connects said spacer member, said fixed cutter element, and said first clamp element together and to said mounting bracket.

4. The apparatus of claim 3, further comprising at least one fixing member connected to said adjusting screw, wherein said at least one fixing member holds said fixed cutter element and said first clamp element at a fixed position relative to one another with said spacer member therebetween.

5. The apparatus of claim 4, wherein said at least one fixing member comprises a retainer fixed to a free end of said adjusting screw and an adjusting nut screwably mounted on said adjusting screw to selectively bear against said mounting bracket.

6. The apparatus of claim 2, wherein said spacer member has a variable dimension in a direction of said spacing distance, wherein said adjustment mechanism further comprises an adjusting screw, wherein said spacer member is arranged between said fixed cutter element and said first clamp element, and wherein said adjusting screw connects said spacer member, said fixed cutter element, and said first clamp element together and to said mounting bracket.

7. The apparatus of claim 6, further comprising at least one fixing member connected to said adjusting screw, wherein said at least one fixing member holds said fixed cutter element and said first clamp element at a selected one of plural selectable positions relative to one another with said spacer member therebetween.

8. The apparatus of claim 7, wherein said at least one fixing member comprises a retainer fixed to a free end of said adjusting screw and an adjusting nut screwably mounted on said adjusting screw to selectively bear against said mounting bracket.

9. The apparatus of claim 2, wherein said adjustment mechanism further comprises an adjusting screw, wherein said spacer member is arranged between said fixed cutter element and said first clamp element, and wherein said adjusting screw connects said spacer member, said fixed cutter element, and said first clamp element together and to said mounting bracket.

10. The apparatus of claim 2, wherein said spacer member comprises a shim block having a selected fixed dimension in a direction of said spacing distance.

11. The apparatus of claim 2, wherein said spacer member comprises a spring that can be at least either compressed or expanded in a direction of said spacing distance.

12. A combination weft clamp and cutter apparatus for an air jet loom, comprising a weft cutter, and a weft clamp including a first clamp element and a second clamp element arranged to selectively cooperate with one another, wherein at least one of said clamp elements is adapted to be movable relative to another of said clamp elements so that a first clamping surface of one of said clamp elements selectively bears with a clamping force against a second clamping surface of another of said clamp elements, wherein at least one of said clamping surfaces comprises an elastic material, wherein at least one of said clamp elements comprises a clamp element body and a clamp jaw insert mounted on said clamp element body, and wherein said clamp jaw insert includes said at least one of said clamping surfaces comprising said elastic materials.

13. The apparatus of claim 11, wherein at least one of said clamp elements consists of said elastic material.

14. The apparatus of claim 12, wherein said clamp jaw insert consists of said elastic material and is removably mounted on said clamp element body.

15. The apparatus of claim 12, wherein said clamping surface comprising said elastic material is a substantially planar surface.

16. The apparatus of claim 15, wherein said substantially planar surface is slanted at an angle relative to an axis of a weft thread that is to be passed through said clamp.

17. The apparatus of claim 12, wherein said clamping surface comprising said elastic material has a profiled surface including a plurality of repetitive profile features.

18. The apparatus of claim 12, wherein said clamping surface comprising said elastic material includes a plurality of angular ridges.

19. The apparatus of claim 18, wherein said ridges are oriented to extend substantially perpendicularly relative to a weft thread that is to be passed through said cutter and said clamp.

20. The apparatus of claim 18, wherein said ridges are oriented to extend diagonally relative to a weft thread that is to be passed through said cutter and said clamp.

21. The apparatus of claim 11, wherein said elastic material is rubber.

22. The apparatus of claim 11, wherein said clamping surface comprising said elastic material has a single V-shaped groove therein extending substantially perpendicularly relative to a weft thread that is to be passed through said clamp.

23. A combination weft thread clamp and cutter apparatus for an air jet loom, comprising a cutter including a fixed cutter element and a movable cutter element that is adapted to be movable relative to said fixed cutter element, a weft clamp including a first clamp element and a second clamp element arranged to selectively cooperate with one another wherein at least one of said clamp elements is adapted to be movable relative to another of said clamp elements, and an adjustment mechanism adjustably connecting said cutter with said weft clamp such that a spacing distance between said weft clamp and said cutter is adjustable, wherein said clamp elements have respective cooperating clamping surfaces, and at least one of said clamping surfaces comprises an elastic material.

24. A combination weft clamp and cutter apparatus for an air jet loom, comprising a weft cutter, and a weft clamp including a first clamp element and a second clamp element arranged to selectively cooperate with one another, wherein at least one of said clamp elements is adapted to be movable relative to another of said clamp elements so that a first clamping surface of one of said clamp elements selectively bears with a clamping force against a second clamping surface of another of said clamp elements, wherein at least one of said clamping surfaces comprises an elastic material, and wherein said clamping surface comprising said elastic material has a profiled surface including a plurality of angular ridges.

25. The apparatus of claim 24, wherein said ridges are oriented to extend substantially perpendicularly relative to a weft thread that is to be passed through said cutter and said clamp.

26. The apparatus of claim 24, wherein said ridges are oriented to extend diagonally relative to a weft thread that is to be passed through said cutter and said clamp.

* * * * *